US009658014B2

(12) United States Patent
Anglisani

(10) Patent No.: US 9,658,014 B2
(45) Date of Patent: May 23, 2017

(54) SAFETY DEVICE FOR A PORTABLE LONG-BARRELLED FIREARM OR PNEUMATIC WEAPON

(71) Applicant: Paolo Anglisani, Leini (IT)

(72) Inventor: Paolo Anglisani, Leini (IT)

( * ) Notice: Subject to any disclaimer, the term of this patent is extended or adjusted under 35 U.S.C. 154(b) by 0 days.

(21) Appl. No.: 14/440,632

(22) PCT Filed: Nov. 6, 2013

(86) PCT No.: PCT/IB2013/002456
§ 371 (c)(1),
(2) Date: May 5, 2015

(87) PCT Pub. No.: WO2014/072790
PCT Pub. Date: May 15, 2014

(65) Prior Publication Data

US 2015/0292827 A1 Oct. 15, 2015

(30) Foreign Application Priority Data

Nov. 6, 2012 (IT) ..... TO2012A0971
Apr. 17, 2013 (IT) ..... TO2013A0308

(51) Int. Cl.
*F41A 17/00* (2006.01)
*F41A 17/22* (2006.01)
*F41A 17/06* (2006.01)

(52) U.S. Cl.
CPC ..... *F41A 17/22* (2013.01); *F41A 17/06* (2013.01)

(58) Field of Classification Search
CPC ..... F41A 17/22; F41A 17/06
USPC ..... 42/70.06
See application file for complete search history.

(56) References Cited

U.S. PATENT DOCUMENTS 660,378 A 10/1900 Kalina
934,065 A * 9/1909 Gates ..... F41A 17/74 42/70.01
1,210,459 A 1/1917 Gile
(Continued)

FOREIGN PATENT DOCUMENTS

BE 902 696 12/1985
NL 1 026 973 C2 3/2006

*Primary Examiner* — Michelle R Clement
(74) *Attorney, Agent, or Firm* — Jason D. Voight

(57) ABSTRACT

1. Safety device for a portable long-barrelled firearm or pneumatic weapon (10), said weapon (A) being gripped by a user with both hands and comprising: a firing mechanism, including at least one trigger (11) operated by the user's hand, a grip (12) held by the user's other hand, and a selective locking mechanism (100) of said firing mechanism, operatively switchable from a deactivated position, in which it allows firing of the weapon, to an activated position, in which it prevents firing of the weapon. According to the invention, said device comprises: means to control the operating condition of said locking mechanism of said firing mechanism (13), which are provided in said grip (12) and, when the weapon is gripped correctly and naturally by the user, automatically cause deactivation of said selective locking mechanism (100), allowing firing of the weapon (A), while, when said grip (12) is released by the user, automatically cause activation of said locking mechanism of said firing mechanism, preventing firing of said weapon (A).

19 Claims, 5 Drawing Sheets

(56) References Cited

U.S. PATENT DOCUMENTS

| | | | | | |
|---|---|---|---|---|---|
| 2,380,140 | A * | 7/1945 | Anderson | F41A 17/46 | 42/70.06 |
| 2,525,886 | A * | 10/1950 | Fraser | F41A 17/20 | 42/70.03 |
| 2,819,550 | A * | 1/1958 | Fischer | F41A 17/20 | 42/41 |
| 4,141,166 | A * | 2/1979 | Schultz | F41A 17/20 | 42/70.01 |
| 4,422,254 | A * | 12/1983 | McQueen | F41A 17/56 | 42/70.05 |
| 4,841,656 | A * | 6/1989 | Brandt | F41A 17/52 | 42/70.01 |
| 5,083,392 | A | 1/1992 | Bookstaber | | |
| 7,281,534 | B2 * | 10/2007 | Bednar | F41B 5/10 | 124/25 |
| 7,779,824 | B2 * | 8/2010 | Bednar | F41B 5/10 | 124/25 |
| 8,713,836 | B1 * | 5/2014 | Haq | F41A 17/54 | 42/70.06 |
| 2007/0261687 | A1 * | 11/2007 | Bednar | F41B 5/10 | 124/25 |
| 2008/0222935 | A1 * | 9/2008 | Christiansen | F41A 17/22 | 42/70.06 |
| 2010/0287807 | A1 * | 11/2010 | Do Amarante | F41A 17/066 | 42/70.06 |
| 2011/0056108 | A1 * | 3/2011 | McCord | F41A 17/066 | 42/70.01 |
| 2013/0019510 | A1 | 1/2013 | Kemmerer et al. | | |
| 2014/0366419 | A1 * | 12/2014 | Allan | F41A 17/06 | 42/70.06 |

* cited by examiner

SAFETY DEVICE FOR A PORTABLE LONG-BARRELLED FIREARM OR PNEUMATIC WEAPON

This is a national stage of International Application PCT/IB2013/002456, filed Nov. 6, 2013.

The present invention relates to a safety device for a portable long-barrelled firearm or pneumatic weapon.

BACKGROUND OF THE INVENTION

It is frequent that, during the utilization of the weapon not gripped for the firing, but anyhow ready for this, or during the transportation of the same, any imbalance or accidental impact may lead to the undeserved firing, both for the falling of the weapon than for an unwanted reaction of the user.

At present, some safety devices for long-barrelled weapons like guns or the like, which allow the firing only if correctly gripped in order to push the stock on the shoulder or against the chin of the user, are known at the state of the art.

The document n. U.S. Pat. No. 1,210,459 A discloses a safety device for a long-barrelled weapon, which is gripped by a user with both hands and comprises:

- a firing mechanism, including at least one trigger activated by one hand of the user;
- a grip, gripped by the other hand of the user, and
- a selective locking mechanism of said firing mechanism, effectively exchangeable between a non-operating position, in which it allows the firing of the weapon, and an operating position, in which it prevents the firing of the weapon. Said locking mechanism comprises control means of its operating condition, provided in the part of the stock of the weapon, to be placed on the shoulder of the user. Only pushing with force the stock of the weapon against the shoulder, the user causes the exchanging of the locking device in the non-operating position in which it allows the firing, but so doing he grips the same weapon in an unnatural way, and so he is not able to correctly aim. Similarly, document n. NL 1026973 C2 discloses a safety device for a portable long-barrelled weapon of the aforementioned type, but where the control means of the operating condition of said locking mechanism are provided on the top part of the stock of the weapon, and only by pushing with force the chin against said part of the stock, the user causes the exchanging of the locking device in the non-operating position in which it allows the firing.

Even in this case, the user grips the same weapon in an unnatural way and so is not able to correctly aim.

On the other hand, said known safety devices comprise a quite complex structure, with all the problems that follows in terms of difficulties of assembly and/or following maintenance.

The present invention, starting from the notion of the aforesaid problems, intends to provide a solution.

An object of the present invention is to provide a safety device for a portable long-barrelled firearm or pneumatic weapon, the operating condition of which, once disconnected the traditional safety lock, causes the inhibition of the firing when the weapon is in any different condition from the one in which it is correctly gripped in order to fire, independently from the occurring of impacts or any other accidental event, and anyhow allows to the user to grip the same weapon in a natural way to correctly aim.

On the other hand, it is also an object of the present invention to provide a safety device as said, further with respect to the traditional safety lock, having a simple structure, light and of easy assembly and following maintenance.

BRIEF SUMMARY OF THE INVENTION

In view of these objects, the present invention provides a safety device for a portable long-barrelled firearm or pneumatic weapon, the essential characteristic of which forms the subject of the main claim or, in other words, said device it is characterized in that it comprises:

- means to control the operating condition of said locking mechanism of said firing mechanism, which are provided in said grip and, when the weapon is gripped correctly and naturally by the user, automatically cause deactivation of said selective locking mechanism, allowing firing of the weapon, while, when said grip is released by the user, automatically cause activation of said locking mechanism of said firing mechanism, preventing firing of said weapon.

Further advantageous characteristics of the invention are described herein. These and other objects, characteristics and advantages of the present invention will be more apparent from the detailed description below with reference to the accompanying drawing, provided purely by way of non-limiting example.

DETAILED DESCRIPTION OF THE INVENTION

Figures 1, 2:
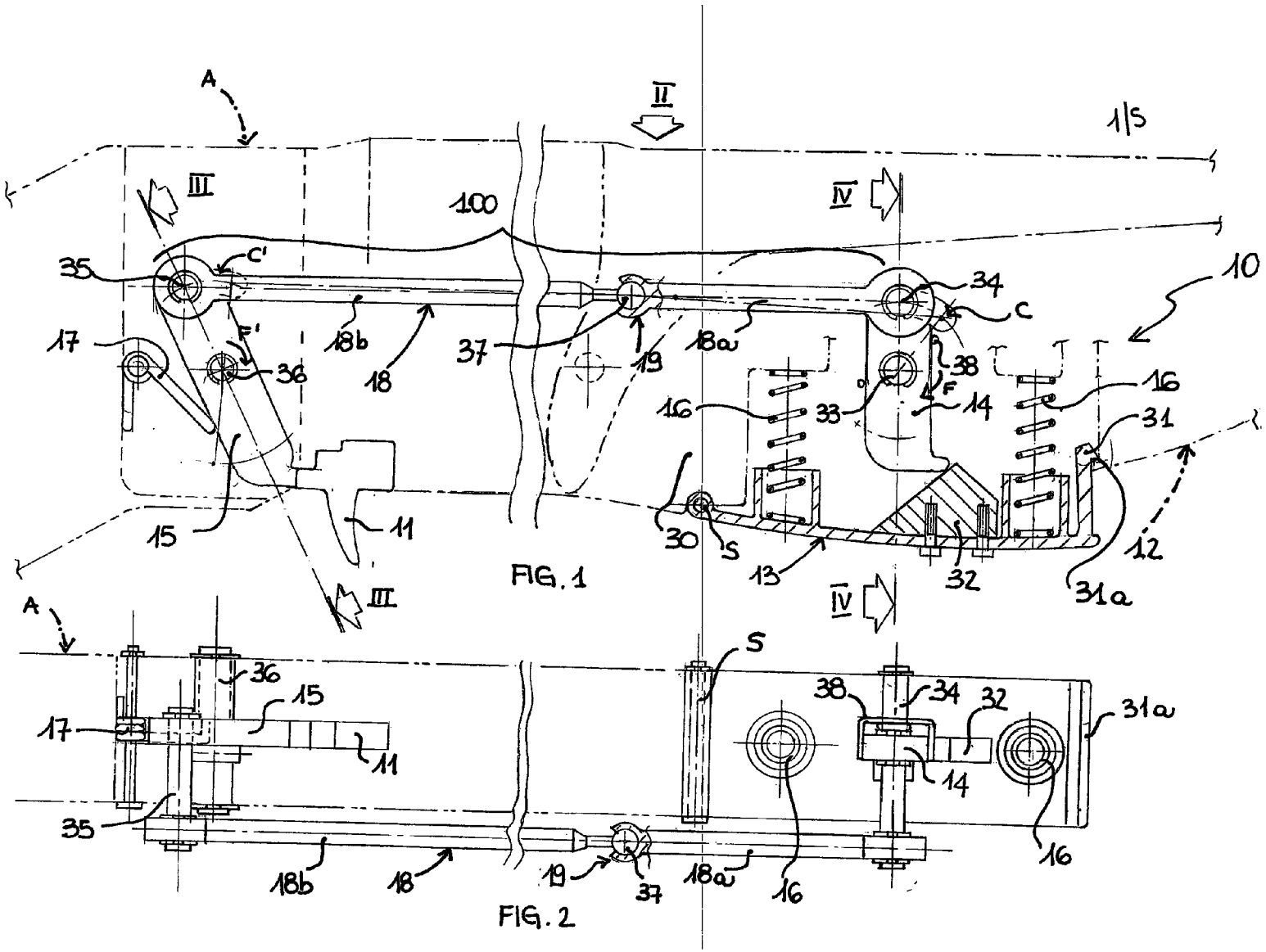
FIG. 1 is a schematic lateral view, and with some broken parts, of the safety device for a portable long-barrelled firearm or pneumatic weapon, according to a first embodiment of the present invention, in which the weapon is only partially outlined with dashed and dotted lines, while the trigger of the same is schematically illustrated with continuous lines, the further parts of the firing mechanism not being illustrated.
FIG. 2 is a plain view from above according to the arrow II of FIG. 1.
Figure 4:
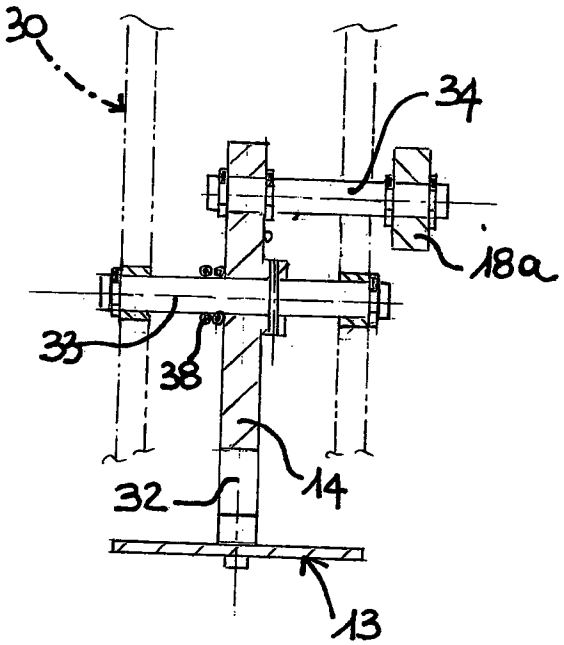
FIG. 4 is a section view according to the line IV-IV of FIG. 1.
Figure 3:
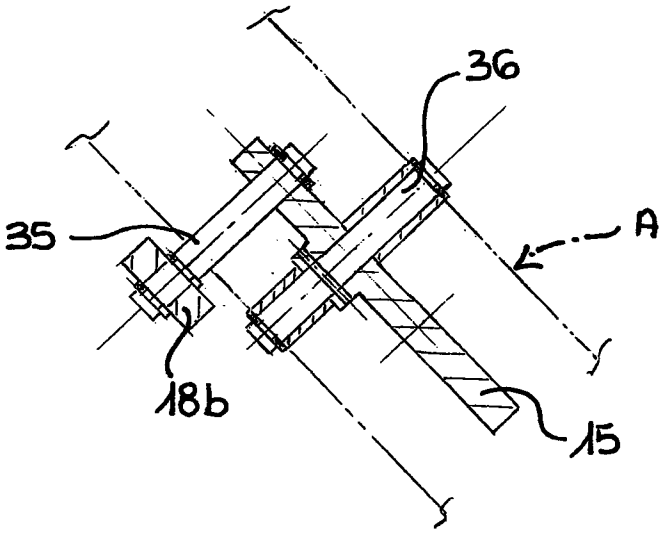
FIG. 3 is a section view according to the line of FIG. 1.

First and Second Embodiments of the Invention (Figures from 1 to 6).

In the aforementioned Figures, with 10, 20 respectively, the safety device for a portable long-barrelled firearm or pneumatic weapon according to a first, a second respectively, embodiment of the present invention, is indicated Said weapon A, A' in which said device 10, 20 is operative, is gripped by a user with both hands and includes:

- a firing mechanism, including at least one trigger 11 operated by the user's hand,
- a grip 12, 22 held by the user's other hand.

With the words "firing mechanism" it is intended to make reference to the whole ensemble of parts kinematically connected and/or coordinated including, for example, in firearms, trigger, hammer, striker and the like, and in pneumatic weapons, for example, trigger, pneumatic seal plunger and relative compressed air chamber; said parts taking part in the process that causes the firing. In the following examples, further than in the relative drawings, non-limitative reference is made to the trigger as a representative part of said firing mechanism.

Said safety device for a portable long-barrelled firearm or pneumatic weapon 10, 20 comprises, at least:

- a moving part 13, 23 of said grip 12, 22;
- a selective locking mechanism 100, 200 of said firing mechanism, kinematically connected with respect to said moving part 13, 23 of said grip 12, 22.

According to the present invention, means to control the operating condition of said locking mechanism of said firing mechanism, are provided in said grip and, when the weapon is gripped correctly and naturally by the user, automatically cause deactivation of said selective locking mechanism, allowing firing of the weapon while, when said grip is released by the user, automatically cause activation of said locking mechanism of said firing mechanism, preventing firing of said weapon.

In particular, said control means comprise a part 13, 23 of said grip 12, 22 movable between a rest position and said selective locking mechanism 100, 200 of said firing mechanism comprises stop means 15 movable between a locking position and a release position of said firing mechanism, which are connected kinematically with respect to said moving part 13, 23 of said grip.

In this way, said grip is gripped correctly and naturally by a user said moving part is automatically set to said operating position and said stop means are automatically set to said release position, while when said grip is released by the user said moving part is automatically set to said rest position and said stop means are automatically set to said locking position. More particularly, said safety device for a portable long-barrelled firearm or pneumatic weapon 10, 20 comprises:

- said moving part 13, 23 of said grip 12, 22;
- a connection mechanism between first oscillating lever means 14, 24, operated by said moving part 13, 23 of said grip 12, 22, and second oscillating lever means 15, which in a first oscillated operating position interfere—directly or indirectly—
- with said firing mechanism, preventing firing of said weapon A, A' (FIG. 1).

When said grip 12, 22 is gripped by the user to fire the weapon A, A', said moving part 13, 23 of the grip is automatically set to said operating position and causes the oscillation of said first lever 14, 24 countering the action of first automatic recall means 16, 26, to an operating position in which said first lever 14, 24, via said connection mechanism, cause said second lever means 15 (not illustrated in FIGS. 5 and 6), to oscillate countering to the action of second automatic elastic recall means (not illustrated in FIGS. 5 and 6, too), to a second oscillated operating position in which the same second lever 15 does not interfere with said firing mechanism, allowing firing of the weapon A, A'.

On the other hand, when said grip 12, 22 is released by the user, said moving part 13, 23 of the grip and said first lever 14, 24 are automatically set, via first automatic recall means 16, 26, further recall means respectively 38, 48, to a respective rest position and, by means of said connection mechanism, make said second lever means 15 to return to said first oscillated operating position, so preventing the firing of said weapon A, A'.

Said connection mechanism comprises at least one connecting rod 18, 28 articulated at its ends with respect to said first 14, 24 and second 15 oscillating levers.

Detailed Description of the First Embodiment of the Safety device for a Portable Long-Barrelled Firearm or Pneumatic Weapon According to the Present Invention (FIGS. 1-4).

In the aforementioned Figures, the safety device for a portable long-barrelled firearm or pneumatic weapon according to a first embodiment of the present invention, is indicated with 10.

In the present embodiment, said moving part 13 of said grip 12 is arranged oscillating about an axis S, with respect to a fixed part 30 of the same grip 12, by the action of the weight of said portable firearm or pneumatic weapon A when gripped by the user. Advantageously, said connecting rod 18 comprises a joint 19 in the intermediate position to allow the opening and closing of said portable firearm or pneumatic weapon A, like a shotgun or the like.

More specifically, said grip 12 comprises said fixed part 30 fixed to the body of the weapon A, and said moving part 13 hinged with respect to said fixed part 30 in the manner of an oscillating cover, normally kept at least partially extended beyond the fixed part 30 by means of a couple of first recall helical compression springs, constituting said first automatic recall means 16, interposed between said two grip parts 13, 30. Retaining means 31 substantially in the shape of a snug, engage in said partially extended position of the oscillating cover 13, a corresponding limit stop protrusion 31*a*, in said fixed part 30. During the use of the weapon, said moving part 13 protrudes downwards with respect to the fixed part 30 of grip.

In its inside, said moving part 13 has a protrusion 32 substantially wedge-shaped.

Said first oscillating lever means 14 are articulated with respect to said fixed part 30 of grip (that is, the body of the weapon), by means of a first pivot 33 which, during the use of the weapon A, has substantially horizontal axis.

At one end, said lever 14 is arranged in sliding contact with respect to an inclined surface of said wedge 32 while, at the other end, said first lever 14 is articulated, by means of a second pivot 34 the axis of which is substantially parallel to the one of said first pivot 33, at one end of said connection part substantially in the shape of a connecting rod 18. Said second pivot 34 is driven in corresponding openings substantially in the shape of a curvilinear slot C, provided in opposite walls of said fixed part 30 of grip.

Said connecting rod 18, at the other end, is articulated, by means of a third pivot 35 the axis of which is substantially parallel to the one of said first pivot 33, at one end of said second oscillating lever means 15, which are pivoted in an intermediate position with respect to the body of said weapon A, by means of a fourth pivot 36, the axis of which is substantially parallel to the one of said firs pivot 33. Said third pivot 35 is driven in corresponding openings substantially in the shape of a curvilinear slot C', provided in opposite walls of said body of the weapon A.

In a first operating position, the free end of said second lever is substantially arranged in contact with the body of the trigger 11 of the weapon, so preventing the movement of the same trigger 11 (FIG. 1).

It will be noted that said connecting rod 18 has two rigid branches 18*a*, 18*b*, each other connected by means of a ball joint 37, in order to allow the compass opening of the same branches 18*a*, 18*b*, in an operating position, and the substantially aligned disposition of said branches 18*a*, 18*b*, in another operating position of said connecting rod 18.

Said first lever 14 and said second lever 15 are automatically recalled in a rest position, in said first oscillated operating position respectively, by means of respective recall coils 38, 17.

In order to allow said safety device 10 to operate, the user grips the weapon A after having at first removed the traditional security lock which prevents the same weapon A from triggering. Then he puts one hand in correspondence to the trigger 11, while disposes the other hand below the moving part 13 of said grip 12. By means of the aforementioned arrangement, said fixed part 30 of grip is lead, by the own weight of the weapon A, to move downwards oscillating with respect to said moving part 13 kept stable by the hand of the user, in antagonism to the elastic action of the recall coils 38, 17.

During such a movement, the inclined surface of said protrusion 32 substantially wedge-shaped engages the free end of said first lever 14, inducing it to oscillate clockwise about said first pivot 33 (arrow F in FIG. 1).

So, said second pivot 34, integral to the other end of said first lever 14, is driven to slide correspondingly in the respective slot-shaped openings C, integrally dragging said connecting rod 18. The latter so causes the corresponding sliding of said third pivot 35 within the corresponding slot-shaped openings C', in order to determine the clockwise sliding of said second lever 15 about the fourth pivot 36 (arrow F' in FIG. 1). Following to such a kinematic behavior of the aforementioned parts, the free end of said second lever 15 departs from the body of the trigger 11, which is so free to oscillate about its own articulation pivot, for the execution of the triggering.

It will be also noted that, as a consequence of the aforementioned kinematic behavior, the respective recall coils 16, 38, 17 of said oscillating cover 14 and of said first lever 14, second 15 respectively, are preloaded.

When the hand of the user releases said moving part 13 of the grip 12, automatically the first recall coils 16 lead the same moving part 13 to oscillate outwards with respect to the grip 12, until a position of maximum extent is reached, in which the snug 31 engages said protrusion 31*a*.

At the same time, said coils 38, 17, make said levers first 14, second 15 respectively, connected one to another by means of said connecting rod 18, to oscillate in the opposite direction (that is, clockwise).

Automatically, as a consequence of said kinematic behaviour, the free end of said second lever 15 arranges itself in its first oscillate operating position, in which it is in contact to a part of the body of the trigger 11, so interfering with respect to the firing mechanism, in order to prevent said trigger 11 to command the trigger of the same weapon A.

In the present embodiment, said moving part 13 is illustrated as articulated, in the manner of a lever with respect to the fixed part 30.

As an alternative, said moving part may be slidingly mounted as a drawer along corresponding guides of the fixed part, and elastic means may keep normally extended said moving part, with respect to the fixed part, in order to be elastically preloaded when the moving part is made tilting in regression with respect to the fixed part, in said disposition said moving part being tiltingly supported with respect to the fixed part.

Figure 5:
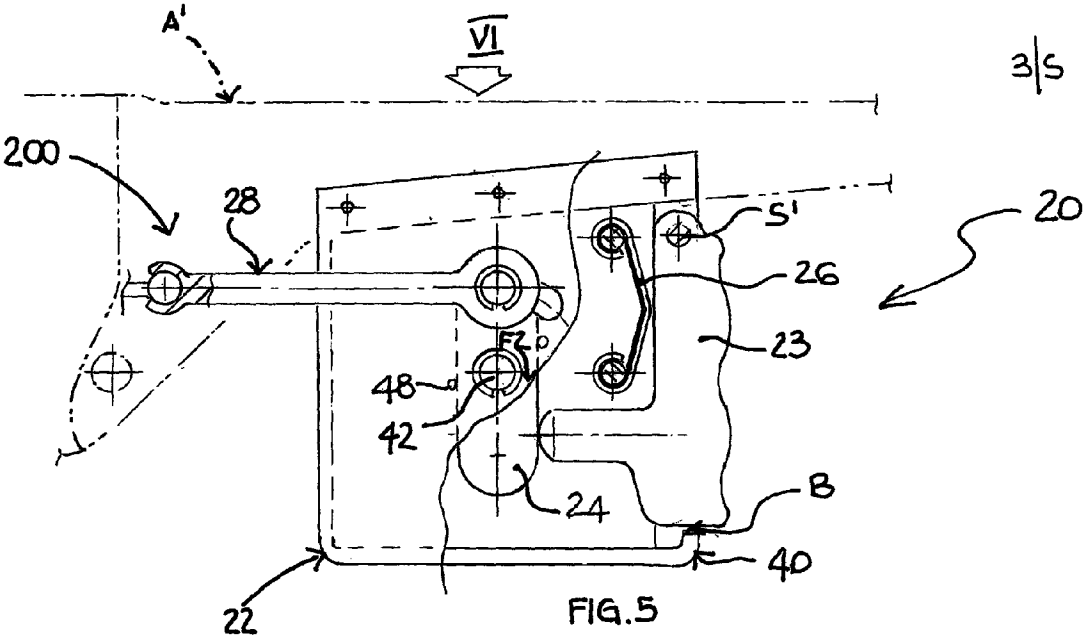
FIG. 5 is a view similar to the one of FIG. 1, but illustrating only a front part of the safety device according to a second embodiment of the present invention.
Figure 6:
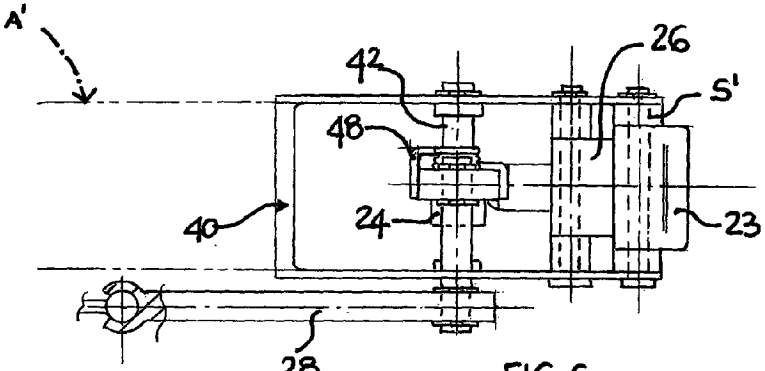
FIG. 6 is a plain view from above according to the arrow VI of FIG. 5.
Figure 7:
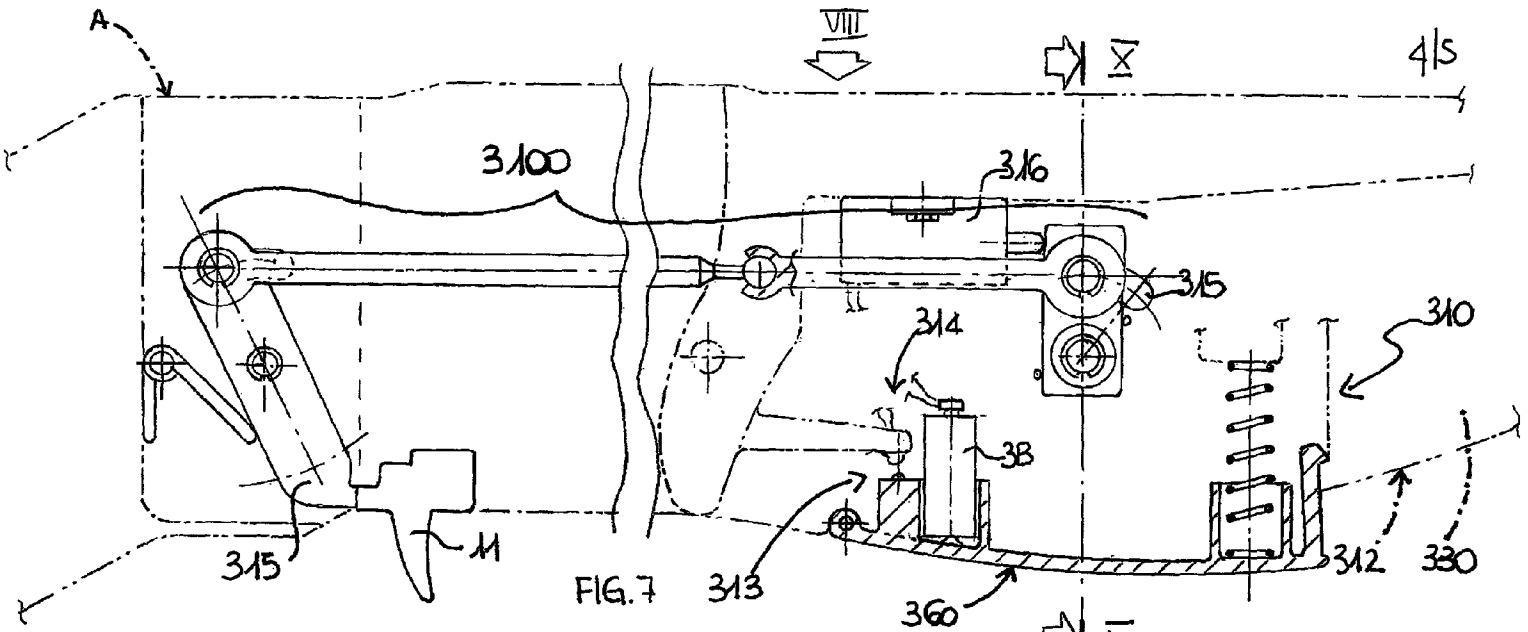
FIG. 7 is a schematic lateral view, and with some broken parts, of the safety device for a portable long-barrelled firearm or pneumatic weapon, according to a third embodiment of the present invention, in which the weapon is only partially outlined with dashed and dotted lines, while the trigger of the same is schematically illustrated with continuous lines, the further parts of the firing mechanism not being illustrated; in said Figure, said firing mechanism being locked by the device according to the invention.
Figure 8:
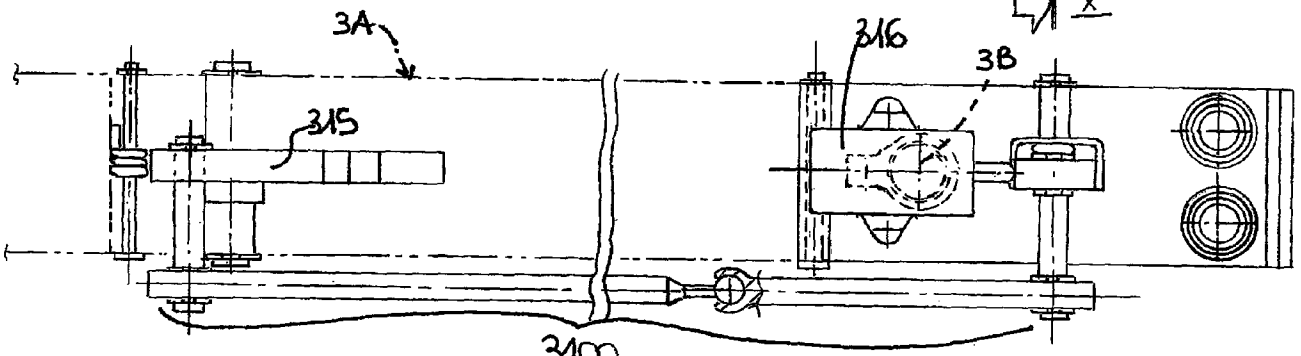
FIG. 8 is a plain view from above according to the arrow VIII of FIG. 7.

Detailed Description of the Second Embodiment of the Safety Device for a Portable Long-Barrelled Firearm or Pneumatic Weapon According to the Present Invention (FIGS. 5 and 6).

In the aforementioned Figures, the safety device for a portable long-barrelled firearm or pneumatic weapon according to a second embodiment of the present invention, is indicated with 20.

In said second embodiment, the structure and disposition of the kinematic components is substantially corresponding to the one described with reference to said first embodiment, to which reference is therefore made; the main difference consists in the structure of the grip 22 of the weapon A', and in particular in the relative arrangement between moving part 23 and fixed part 40 of said grip 22, which is made as a box-shaped body.

Said moving part 23 of said grip 22 is arranged oscillating about an axis S' fixed to said fixed part 40 of the same grip 22 by the tightening and release action of the hand of the same.

More particularly, said moving part 23 of gripping is oscillating mounted with respect to a substantially vertical opening B and facing the front part of the weapon A', in said grip 22 substantially box-shaped. Said moving part 23 of gripping acts with respect to said first lever means 24, when manually led to re-enter in said box-shaped body of the grip 22, according to a pre-determined direction, preloading said recall means 26, substantially made as a leaf spring.

By means of such arrangement, when the user grips said grip 22 and tightens his hand on it, said moving part 23 is made to retrocede in antagonism with respect to the action of said elastic means 26, and causes the corresponding oscillation (in clockwise direction according to the arrow F2 of FIG. 5), about said first pivot 42 of said first lever means 24, which correspondingly trail said connection mechanism in a very similar manner to what described with reference to said first embodiment. It will be noted that said connection mechanism is very similar to the one of the aforementioned first embodiment, and so it is not further described and illustrated.

By the way, in the case said weapon A' does not need an opening and closing in the manner of a shotgun, said connection means may be constituted by a simple non-articulated connecting rod.

Exemplificative Variant of Embodiment of the Safety Device for a Portable Long-Barrelled Firearm or Pneumatic Weapon According to the Present Invention (Not Illustrated).

In said variant of embodiment (not illustrated), the structure and disposition of the kinematic components is substantially corresponding to the one described with reference to the preceding embodiments, from which it differs substantially in the fact that said connection mechanism comprises, instead of articulated connection rod means, flexible means of connection with respect to said first and second oscillating levers.

As evident in the light of the foregoing, said safety device as said automatically prevents the firing when the weapon is in any condition different from the position in which it is correctly and naturally gripped for the execution of the firing, independently from the occurring of impacts or the like, even regardless of the voluntary insertion of the traditional safety lock.

On the other hand, the safety device according to the present invention has a simple structure, light and of easy assembly and following maintenance.

As clear from the foregoing, the present invention allows the objects set forth in the introduction of the present description to be achieved in a simple and effective manner.

Third Embodiment of the Safety Device for a Portable Long-Barrelled Firearm or Pneumatic Weapon According to the Present Invention (FIGS. 7-10).

In the aforementioned Figures, the safety device for a portable long-barrelled firearm or pneumatic weapon 3A according to said third embodiment of the present invention, is overall indicated with 310.

Said portable long-barrelled firearm or pneumatic weapon 3A, is gripped by the user with both hands to execute the firing, and comprises:

a firing mechanism, including a kinematic chain of parts, moved by at least one trigger 311, operated for firing by a hand of the user, and that causes the operating of at least one striker (not illustrated), and a grip 312 held by the user's other hand.

Further, said device 310 according to the invention, comprises (FIG. 7):

a selective locking mechanism 3100 of said firing mechanism, operating in a certain point of said kinematic chain of parts. The device according to the invention also comprises means to control the operating condition of said locking mechanism 3100 of said firing mechanism, which are provided in said grip 312 and, when the weapon is gripped correctly and naturally by the user, automatically cause deactivation of said selective locking mechanism 3100, allowing firing of the weapon 3A, while, when said grip (12, 22, 312, 322) is released by the user, automatically cause activation of said locking mechanism of said firing mechanism, preventing firing of said weapon 3A.

In particular, said control means comprise electrical/electronic switch means 313 provided in said grip 312 for electrical opening/closing (on/off positions) of a corresponding electrical/electronic circuit 314 to control the operating condition of said selective locking mechanism 310, and said selective locking mechanism 3100 comprises stop means 315 movable between a locking position and a release position of said firing mechanism, so that, when said grip 312 is correctly gripped by a user, said electrical/electronic switch means 313 are automatically activated (on position) and said stop means 315 are automatically set to said release position, while when said grip 312 is released by the user, said electrical/electronic switch means 313 are automatically deactivated (off position) and said stop means 315 are automatically set to said locking position.

Thus, when the user correctly and naturally grips the grip 312 of said weapon 3A for firing, said switch 313 is automatically operated by the same user, and closes the corresponding electrical/electronic circuit 314, which deactivates said locking mechanism 3100 so allowing firing of the weapon 3A while, when the user releases said grip 312, said control switch 313 is automatically deactivated and causes the opening of said electrical/electronic circuit 314, so allowing the automatic re-activation of said locking mechanism 3100, which prevents the firing of said weapon 3A.

Said device 310 does not need, to the purpose of its activation, deactivation respectively, any voluntary behavior by the user, who is so able to maintain an absolutely spontaneous behavior in movements, without having this to interfere with the proper operation of the safety device 310.

In adding, the utilization of said control switch 313 allows to reach an elevate quickness of response, further than relative restrained weight and dimensions.

The alimentation of said electrical/electronic circuit 314 may advantageously comprise at least a common battery B1, rechargeable or disposable.

Different types of alimentation, provided they are compatible, are similarly possible according to the present invention. Advantageously, said locking mechanism 3100 comprises electrical actuator means 316, which are connected electrically with respect to said electrical circuit 314 and kinematically with respect to oscillating lever means 315. When said electrical circuit 314 is open, said electrical actuator means 316 cause movement of said oscillating lever means 315 to a first oscillated operating position (FIG. 7), in which they interfere—directly or indirectly—with respect to said firing mechanism (in this case, the striker 311), preventing the firing of said weapon 3A, while when said electrical circuit 314 is closed (FIG. 9), said electrical actuator means 316 cause movement of said lever means 315 to a second oscillated operating position, in which they do not interfere—directly or indirectly—with respect to said firing mechanism, allowing firing of the weapon 33A.

In the present embodiment, said electrical actuator means 316 are electrically connected in an electrical circuit 314 through electrical/electronic switch means 313 provided in said grip 312. Said electrical/electronic control switch 313 of said selective locking mechanism 3100 comprises a movable part 360 of said grip 312 which, when the user grips said weapon 3A correctly and naturally to fire, it causes the closure of said electrical/electronic circuit 314 and corresponding deactivation of said locking mechanism 3100, allowing firing of the weapon 3A, while when the user releases said grip 312, causes opening of said electrical/electronic circuit and, correspondingly, re-activation of said locking mechanism 3100, which prevents firing of said weapon 3A.

More particularly (reference is made to FIGS. 7 and 9) said moving part 360 is arranged oscillating, respectively tilting, with respect to a fixed part 330 of the same grip 312, by the action of the weight of said portable firearm or pneumatic weapon 3A when gripped by the user.

In variant (not illustrated), said moving part is included in traditional electric button means, provided in said fixed part of said grip, and are operated in electrical closing and opening by tightening and, respectively, opening of the hand of the user that utilizes the weapon.

Figures 9, 10, 11:
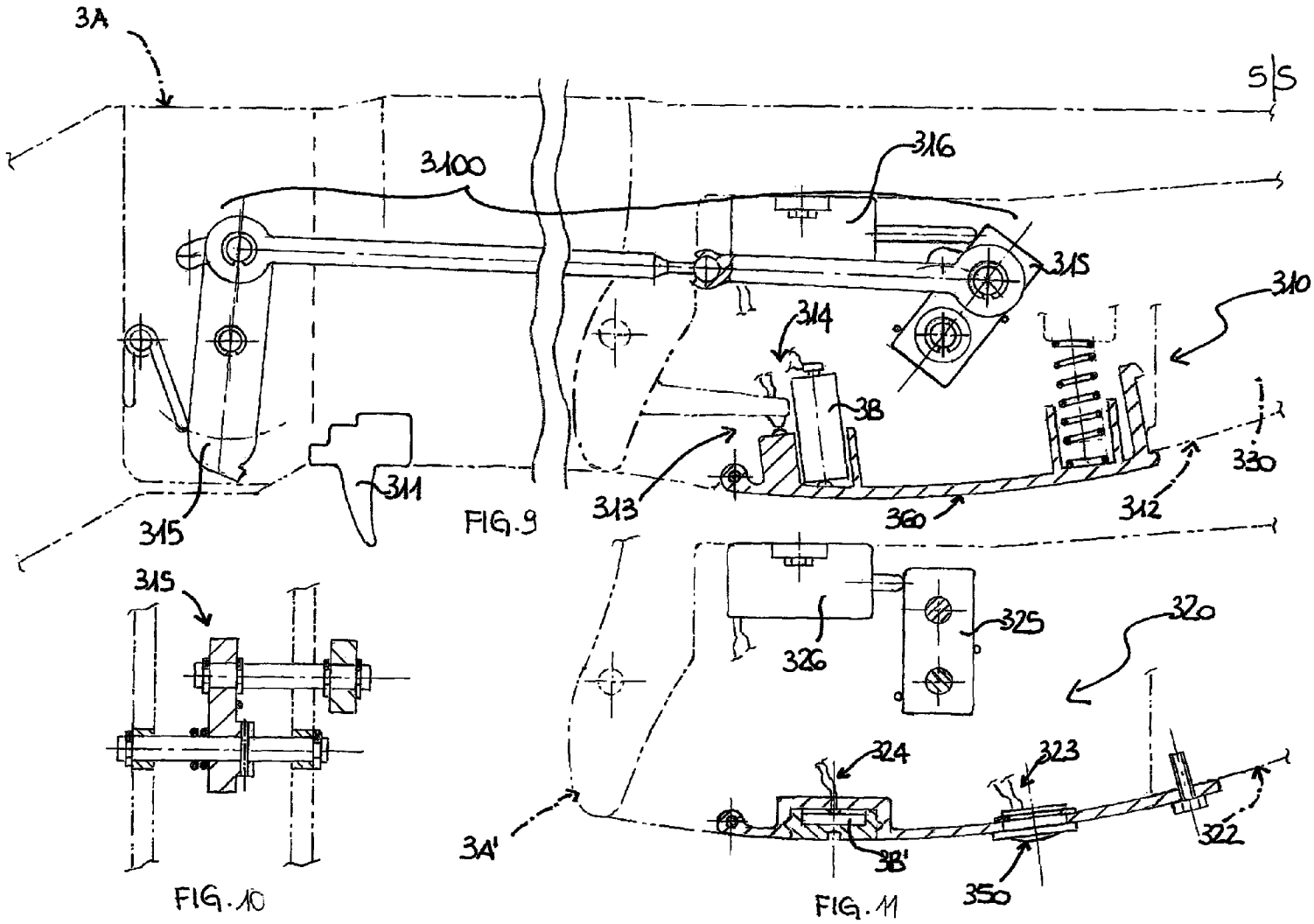
FIG. 9 is a view similar to the one of FIG. 7, but in which said firing mechanism is not unlocked.
FIG. 10 is a section view according to the line X-X of FIG. 7.
FIG. 11 is a view similar to the one of FIG. 7, but illustrating only a front part of the safety device according to a fourth embodiment of the present invention.

Fourth Embodiment of the Safety Device for a Portable Long-Barrelled Firearm or Pneumatic Weapon According to the Present Invention (FIG. 11).

In the aforementioned Fiures, the safety device for a portable long-barrelled firearm or pneumatic weapon 3A' according to said fourth embodiment of the present invention, is overall indicated with 320.

In said second embodiment, the structure and disposition of the kinematic components is substantially corresponding to the one described with reference to said third embodiment, to which reference is therefore made without further description.

The main difference with respect to the aforementioned third embodiment consists in the fact that said electric/electronic switch control means 323, here in electronic version, of said selective locking mechanism (not illustrated) comprise electrical/electronic sensor means 350 (for example, photocell means), provided in said fixed part of said grip 322 which, when the user correctly and naturally grips the weapon 3A' for firing, cause closing of said electric circuit 324 and corresponding de-activation of said selective locking mechanism, allowing firing of the weapon 3A' while, when the user releases the grip, cause opening of said electrical circuit 324 and, correspondingly, re-activation of said selective locking mechanism, which prevents firing of said weapon 3A'.

Being said sensors 350 sensible to the presence of the hand of the user on said grip 322, they automatically cause the inhibition of firing in any different condition from the one in which it is correctly gripped in order to fire, independently from any voluntary behaviour of the user.

In adding, the present embodiment differs from the preceding one in the fact that said electrical actuator means 326 are electrically connected in an electrical circuit 324 with said electrical sensor means 350 provided in said grip 322, by means of a electric battery 3B', in this case a button-type battery.

In a very similar way to what already said with reference to the above mentioned third embodiment, said locking mechanism comprises electrical actuator means 326 which are connected electrically with respect to said electrical circuit 324 and kinematically with respect to oscillating lever means 325. When said electrical circuit 324 is open (in absence of a hand of the user gripping said grip 322), said electrical actuator means 326 cause movement of said oscillating lever means 325 to a first oscillated operating position, in which they interfere—directly or indirectly—with said firing mechanism, preventing firing of said weapon 3A', while when said electronic circuit 324 is closed (in presence of a hand of the user gripping said grip 322), said electrical actuator means 326 cause the movement of said lever means 325 to a second oscillated operating position, in which they do not interfere—directly or indirectly—with said firing mechanism, allowing firing of the weapon 3A'.

As evident in the light of the foregoing, said safety device 310, 320 for a portable long-barrelled firearm or pneumatic weapon, according to the present invention, ensures an elevate level of quickness in response, when necessary.

Further, said safety device 310, 320 as above specified has an overall relative light weight, with all the consequences in terms of convenience of utilization and transport by the user.

On the other hand, the safety device 310, 320 as said has relative restrained dimensions, with consequent possibility of miniaturization.

As clear from the foregoing, the present invention allows the objects set forth in the introduction of the present description to be achieved in a simple and effective manner.

The invention claimed is:

1. Safety device for a portable long-barrelled firearm or pneumatic weapon, said weapon intended to be gripped by a user with both hands and comprising:

a firing mechanism, including at least one trigger intended to be operated by the user's hand, a grip intended to be held by the user's other hand, and a selective locking mechanism of said firing mechanism, operatively switchable from a deactivated position, in which it allows firing of the weapon, to an activated position, in which it prevents firing of the weapon, characterized in that it comprises:

a control means to control the operating condition of said locking mechanism of said firing mechanism, said control means including a pivotally moving part, which pivotally moving part is provided in said grip and, which pivotally moving part is configured to pivotally move into an operating position to automatically cause deactivation of said selective locking mechanism, allowing firing of the weapon when the weapon is gripped correctly and naturally by the user, while, which pivotally moving part is configured to pivotally move into a rest position to automatically cause activation of said locking mechanism of said firing mechanism, preventing firing of said weapon (A, A', 3A, 3A') when said grip is released by the user.

2. Safety device according to claim 1, characterized in that said selective locking mechanism of said firing mechanism comprises a stop means movable between a locking position and a release position of said firing mechanism, which is connected kinematically with respect to said pivotally moving part of said grip, so that when said grip is gripped correctly and naturally by a user said pivotally moving part is automatically set to said operating position and said stop means is automatically set to said release position, while when said grip is released by the user said pivotally moving part is automatically set to said rest position and said stop means is automatically set to said locking position.

3. Safety device according to claim 2, characterized in that it comprises:

a connection mechanism between a first pivotal lever, operated by said pivotally moving part of said grip, and the stop means which is in the form of a second pivotal lever, which in a first operating position interfere—directly or indirectly—with said firing mechanism, preventing firing of said weapon, and in that when said grip is gripped by the user to fire the weapon, said pivotally moving part of the grip is automatically set to said operating position and causes pivoting of said first lever means, countering the action of a first automatic recall means, to an operating position in which said first lever means, via said connection mechanism, cause said second lever to pivot to a second operating position, in which said second lever does not interfere—directly or indirectly—with said firing mechanism, allowing firing of the weapon, while when said grip is released by the user, said pivotally moving part of the grip and said first lever are automatically set, via the first automatic recall means, to a respective rest position and allow said second lever to automatically return to said first operating position, preventing firing of said weapon.

4. Safety device according to claim 3, characterized in that said connection mechanism comprises at least one connecting rod jointed at its ends with respect to said first and second levers, to provide a jointed connection between said first and second levers.

5. Safety device for a portable long-barrelled firearm or pneumatic weapon according to claim 4, characterized in that said connecting rod comprises a joint in an intermediate position to allow the opening and closing of said portable firearm or pneumatic weapon.

6. Safety device for a portable long-barrelled firearm or pneumatic weapon according to claim 2, characterized in that said pivotally moving part of said grip is arranged pivotally, respectively tilting, with respect to a fixed part of the grip, by the action of the weight of said portable firearm or pneumatic weapon when gripped by the user.

7. Safety device for a portable long-barrelled firearm or pneumatic weapon according to claim 2, characterized in that said pivotally moving part of said grip is arranged pivotally movable with respect to a fixed part of the grip (22), by the tightening and release action of the hand of the user gripping the weapon.

8. Safety device for a portable long-barrelled firearm or pneumatic weapon according to claim 3, characterized in that said connection mechanism comprises flexible means connected with respect to said first and second lever means.

9. Safety device for a portable long-barrelled firearm or pneumatic weapon according to claim 3, characterized in that it comprises second automatic recall means of said second lever, which automatically re-set said second lever to said first operating position when said grip is released by the user, so that said second lever interferes—directly or indirectly—with said firing mechanism, preventing firing of said weapon.

10. Safety device for a portable long-barrelled firearm or pneumatic weapon according to claim 1, characterized in that said control means comprises an electrical/electronic switch provided in said grip for electrical opening/closing (on/off positions) of a corresponding electrical/electronic circuit to control the operating condition of said selective locking mechanism, and in that said selective locking mechanism comprises stop means movable between a locking position and a release position of said firing mechanism, so that, when said grip is correctly gripped by a user, said electrical/electronic switch is automatically activated (on position) and said stop means is automatically set to said release position, while when said grip is released by the user, said electrical/electronic switch means is automatically deactivated (off position) and said stop means is automatically set to said locking position.

11. Safety device according to claim 10, characterized in that said electrical/electronic switch is electrically connected in said electrical/electronic control circuit of said selective locking mechanism comprising the pivotally moving part of said grip which, when the user grips said weapon correctly and naturally to fire it, causes of said electrical/electronic circuit and corresponding deactivation of said locking mechanism, allowing firing of the weapon, while when the user releases said grip, causes opening of said electrical/electronic circuit and, correspondingly, re-activation of said locking mechanism, which prevents firing of said weapon.

12. Safety device according to claim 11, characterized in that said pivotally moving part is arranged pivotally, respectively tilting, with respect to a fixed part of the grip, by the action of the weight of said portable firearm or pneumatic weapon when gripped by the user.

13. Safety device according to claim 11, characterized in that said pivotally moving part is included in said electrical/electronic switch, provided in a fixed part of said grip and which are operated in electrical closing and opening by means of tightening and, respectively, opening of the hand of the user of the weapon.

14. Safety device according to claim 10, characterized in that said electrical/electronic switch comprises an electrical/electronic sensor provided in said fixed part of said grip which, when the user grips said weapon correctly and naturally to fire it, cause closing of said electrical/electronic circuit and corresponding de-activation of said selective locking mechanism, allowing firing of the weapon, while when the user releases the grip, cause opening of said electrical/electronic circuit and, correspondingly, re-activation of said selective locking mechanism, which prevents firing of said weapon.

15. Safety device according to claim 10, characterized in that said locking mechanism comprises an electrical actuator, which is connected electrically with respect to said electrical/electronic circuit and kinematically with respect to said stop means which is in the form of a pivotal lever, and in that, when said electrical/electronic circuit is open, said electrical actuator causes movement of said pivotal lever to a first oscillated operating position, in which they interfere—directly or indirectly—with said firing mechanism, preventing firing of said weapon, while when said electrical/electronic circuit is closed, said electrical actuator causes movement of said pivotal lever to a second operating position, in which it does not interfere —directly or indirectly —with said firing mechanism, allowing firing of the weapon.

16. Safety device according to claim 10, characterized in that said electrical actuator is electrically connected in an electrical/electronic circuit with an electrical/electronic switch provided in said grip.

17. Safety device according to claim 14, characterized in that said electrical actuator is electrically connected in an electrical/electronic circuit with said electrical/electronic sensor provided in said grip.

18. Safety device according to claim 1, wherein said grip comprises a fixed part, said pivotally moving part is hinged with respect to said fixed part, and said pivotally moving part is biased into the rest position by recall means such that said pivotally moving part extends beyond the fixed part of the grip when the pivotally moving part is in the rest position, and wherein the biasing force of the recall means is less than the weight of the weapon.

19. Safety device according to claim 18, wherein said pivotally moving part is in the form of a cover, said cover comprising a retaining means substantially in the shape of a snug which limits the extent of which the cover can extend beyond the fixed part.

* * * * *